United States Patent [19]

Lemense

[11] Patent Number: 4,907,570

[45] Date of Patent: Mar. 13, 1990

[54] WATER HEATER WITH UPWARDLY SLIDING OUTER JACKET

[75] Inventor: Rodney A. Lemense, Hartland, Wis.

[73] Assignee: A.O. Smith Corporation, Milwaukee, Wis.

[21] Appl. No.: 293,683

[22] Filed: Jan. 5, 1989

[51] Int. Cl.[4] ..... A47J 27/00; F24H 1/00

[52] U.S. Cl. ..... 126/373; 126/350 R; 220/444; 220/445; 220/447; 220/67; 220/68; 220/431

[58] Field of Search ..... 126/373, 350; 220/444, 220/445, 447, 431, 432, 433, 68, 70, 67

[56] References Cited

U.S. PATENT DOCUMENTS

| | | | |
|---|---|---|---|
| 1,173,335 | 12/1916 | Angelo et al. | 220/447 X |
| 2,099,113 | 11/1937 | Hollnagel | 220/447 |
| 2,103,678 | 12/1937 | Kline et al. | 220/447 X |
| 3,253,731 | 5/1966 | Fink et al. . | |
| 3,516,566 | 6/1970 | Franck | 220/444 |
| 3,768,687 | 10/1973 | Spencer | 220/431 |
| 4,372,028 | 2/1983 | Clark et al. . | |
| 4,447,377 | 5/1984 | Denton . | |
| 4,477,399 | 10/1984 | Tilton . | |
| 4,527,543 | 7/1985 | Denton . | |
| 4,628,184 | 12/1986 | West . | |
| 4,632,792 | 12/1986 | Clark . | |
| 4,651,894 | 3/1987 | Ebert | 220/445 |
| 4,736,509 | 4/1988 | Nelson . | |
| 4,744,488 | 3/1988 | Nelson . | |
| 4,749,532 | 6/1988 | Pfeffer . | |
| 4,790,290 | 12/1988 | Chevalier et al. . | |

*Primary Examiner*—Larry Jones

*Attorney, Agent, or Firm*—Andrus, Sceales, Starke & Sawall

[57] ABSTRACT

A water heater (40) includes a lower skirt ring (42) supporting and spacing an inner storage tank (2) above a support surface (10*a*), and an outer jacket (44, 56, 70) slid upwardly along the inner storage tank and having a lower end (48, 60) extending radially inwardly to mate with the inner storage tank and form a dam sealing the annular cavity space (22) between the tank and jacket, which dam prevented leakage therepast during foamed insulation. Various outer jacket (44, 56, 70, 82, 100) combinations are disclosed with convex (9*a*) Tank Bottoms. In other embodiments, the lower radially inwardly extending end (74, 86, 98) of the outer jacket engages the underside of a flange (76, 96) formed on the skirt ring (42, 90), to form the dam as the outer jacket is slid upwardly along the inner tank.

14 Claims, 3 Drawing Sheets

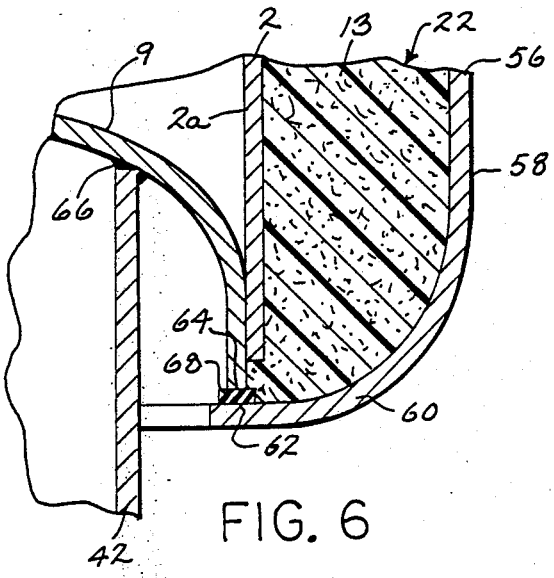
FIG. 6
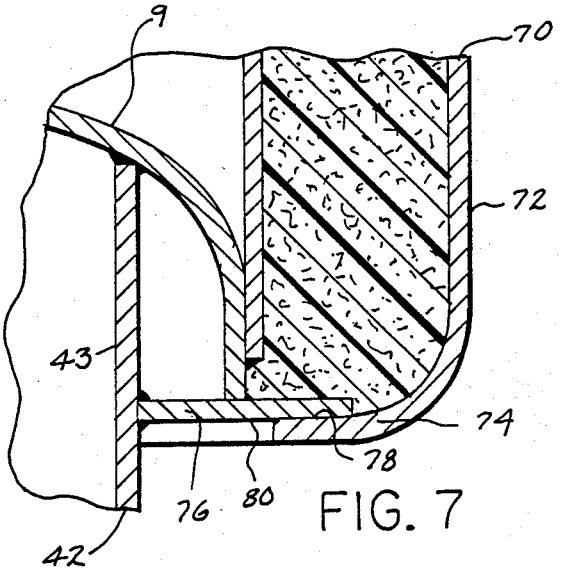
FIG. 7
FIG. 8
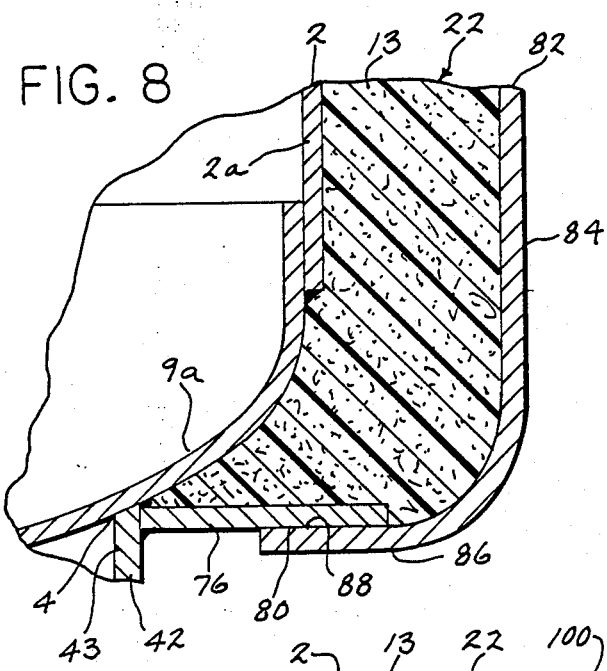
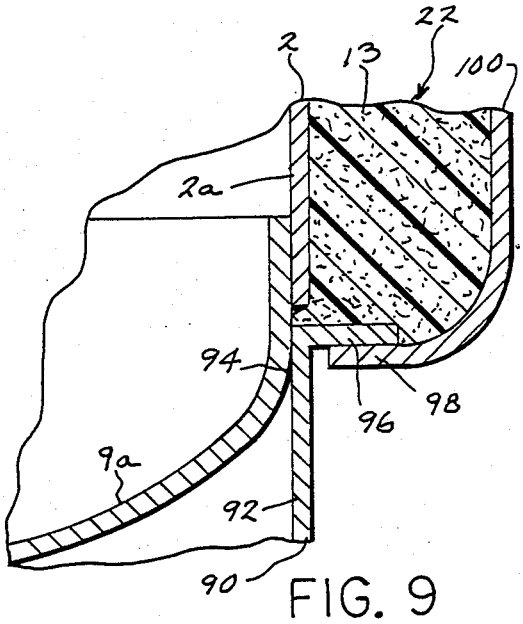
FIG. 9
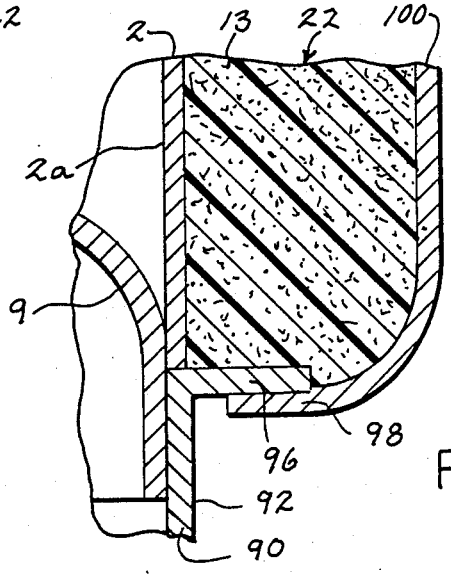
FIG. 10

WATER HEATER WITH UPWARDLY SLIDING OUTER JACKET

BACKGROUND AND SUMMARY

The invention relates to insulated fluid storage units, including hot water heaters.

Hot water heaters for domestic and other applications include an inner storage tank having an associated heating unit for heating water in the tank. The tank is enclosed with suitable insulation to retain the heat and minimize the necessity for frequent reheating. An outer aesthetically pleasing jacket or shell is provided to enclose the insulation.

A highly satisfactory insulating material is expandable foamed insulation such as expanding foamed polyurethane. The insulation is applied in a fluid state into the annular cavity space between the inner storage tank and the outer jacket and foams and expands to produce a rigid and closely adhering insulating enclosure about the inner tank.

Gas water heaters are provided with a burner aligned with the bottom of the storage tank. A skirt ring supports and spaces the tank above a support surface or base and defines a firing chamber. Polyurethane produces toxic fumes when burned, and hence must be protected from the temperature and flame of the heating unit. Various isolation sealing dams have been devised to deal with this problem, such as an inflatable donut bag, Clark et al U.S. Pat. No. 4,372,028, Tilton U.S. Pat. No. 4,477,399, a fiberglass collar, Pfeffer U.S. Pat. No. 4,749,532, Nelson U.S. Pat. No. 4,736,509, and an envelope bag. Denton U.S. Pat. Nos. 4,447,377, 4,527,543.

The present invention provides an improved dam which is simple and cost effective in manufacture.

BRIEF DESCRIPTION OF THE DRAWINGS

Prior Art

Present Invention

Figure 1:
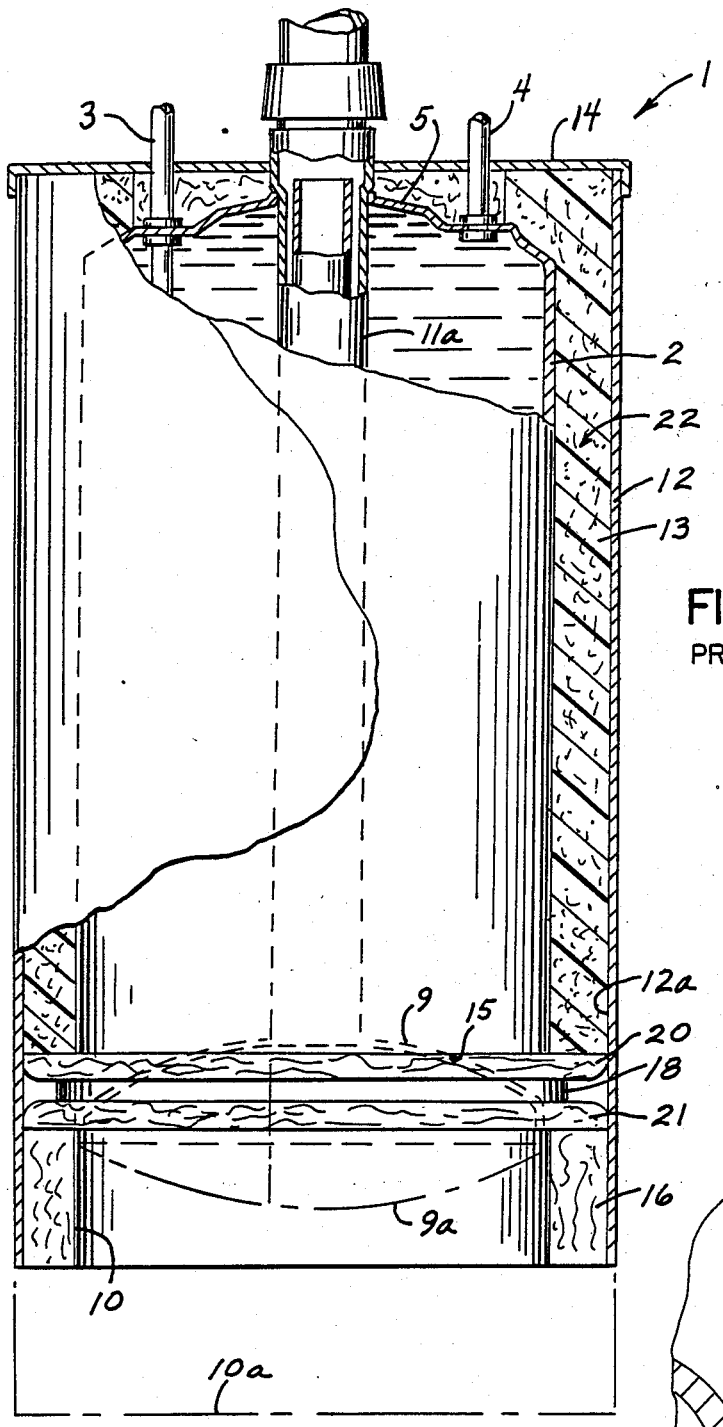
FIG. 1 PRIOR ART
FIG. 1 is a side elevation view of a hot water heater, partially broken away, known in the prior
Figure 3:
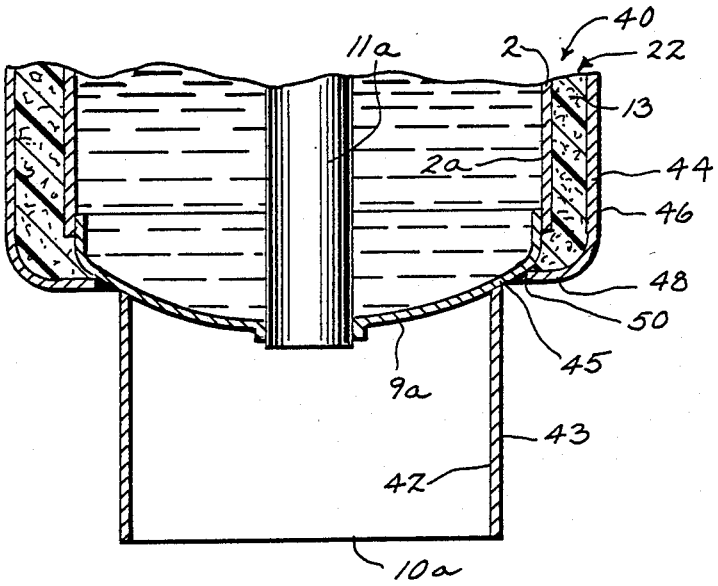

FIG. 3 is a view like a portion of FIG. 1 and shows the present invention.

Figure 4:
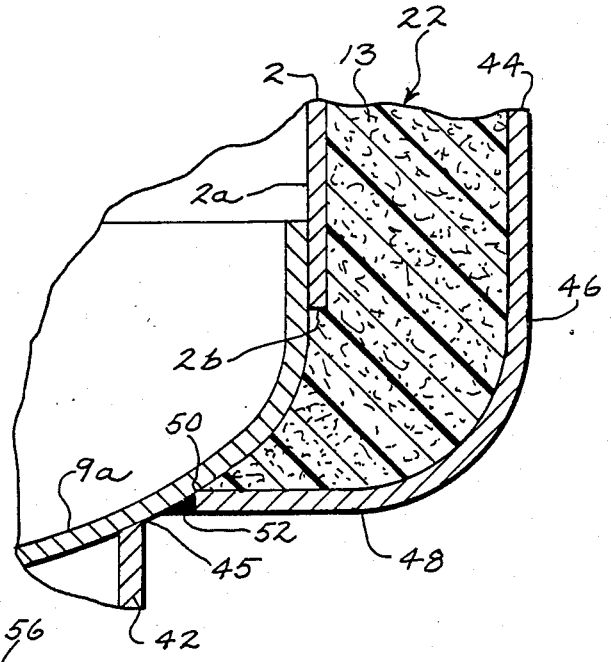

FIG. 4 is an enlarged view of a portion of FIG. 3.

Figure 5:
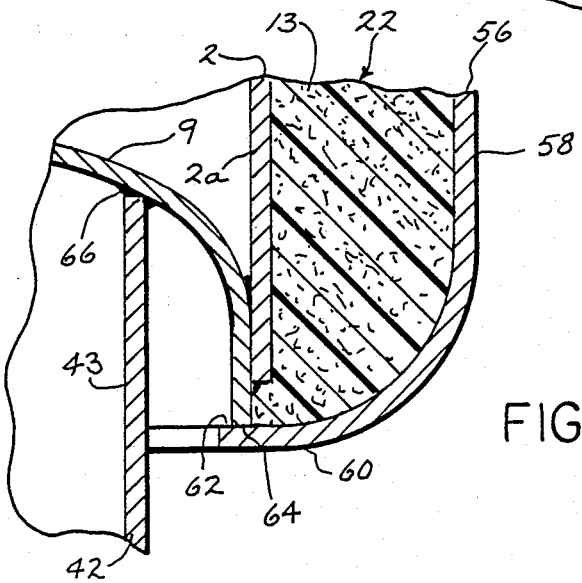

FIG. 5 is a view like FIG. 4 and shows an alternate embodiment.

FIG. 6 is a view like FIG. 5 and shows an alternate embodiment.

FIG. 7 is a view like FIG. 6 and shows an alternate embodiment.

FIG. 8 is a view like FIG. 7 and shows an alternate embodiment.

FIG. 9 is a view like FIG. 8 and shows an alternate embodiment.

FIG. 10 is a view like FIG. 9 and shows an alternate embodiment.

DETAILED DESCRIPTION

Prior Art

Figure 2:
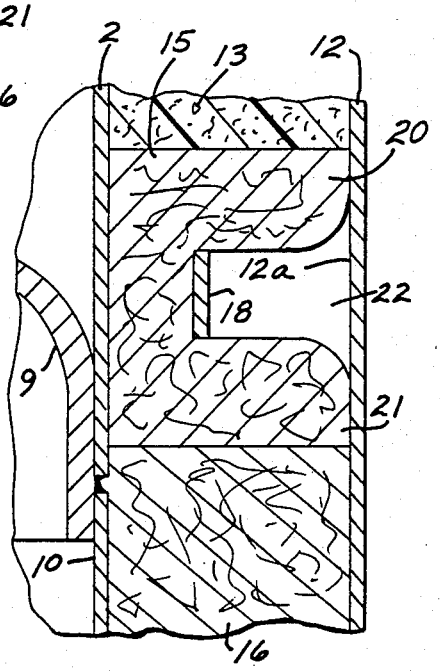
FIG. 2 PRIOR ART
FIG. 2 is an enlarged view of a portion of FIG. 1.

FIGS. 1 and 2 show a hot water heater 1 known in the prior art, for example as shown in Pfeffer U.S. Pat. No. 4,749,532, incorporated herein by reference. FIGS. 1 and 2 use like reference numerals from the incorporated Pfeffer patent where appropriate to facilitate clarity. Inner steel storage tank 2 has water inlet and outlet connections 3 and 4 at domed top wall 5. Tank 2 may have a concave bottom wall as shown in dashed line at 9, and as shown in the incorporated Pfeffer patent, or may have a convex bottom wall as shown in dashed line at **9*a*. Lower annular steel skirt ring 10 is welded to tank 2 and supports and spaces tank 2 above a support surface or base shown in dashed line at 10*a*. The full vertical height of skirt ring 10 is not shown, and will vary depending upon application. Skirt ring 10 defines a fire box or chamber within which is mounted the heater unit, for example as shown at 11 in FIG. 2 of the incorporated Pfeffer patent. Skirt ring 10 may rest directly on the floor and have cut-outs therein to supply combustion air to the fire box chamber, or the support surface or base 10*a* may have cut-outs therein and be supported above the floor by legs (not shown). Flue duct 11*a* is mounted centrally of tank 2 and extends upwardly beyond top tank wall 5 for exhausting waste gases of combustion. The inner surface of tank 2, as well as the outer surface of flue 11*a***, can be coated with a conventional corrosion resistant coating (not shown) such as glass or vitreous enamel.

An outer aesthetically pleasing jacket or shell 12 formed of relatively thin metal is spaced outwardly of inner tank 2 to define an annular cavity space 22 therebetween. Foamed insulation 13 is introduced as a liquid into annular space 22 and hardens to form an annular insulation layer around inner storage tank 2, for which further reference may be had to the incorporated Pfeffer patent, including FIG. 7 thereof. Insulation 13 extends upwardly over top wall 5 of tank 2. A jacket cover 14 is secured to the top of jacket 12 and maintains an aesthetically pleasing outer enclosure and defines an upper space (which is filled with insulation 13. The lower end of insulation 13 is defined by an encircling fiberglass belt 15 providing a dam blocking passage of liquid therepast during the foaming insulation process. The dam isolates insulation 13 from the heater unit below the tank. Belt 15 is wrapped around the tank and held thereto by an encircling cinch band 18 tightened to cause the upper and lower ends 20 and 21 of belt 15 to bulge or flare outwardly to fill the gap to the inner wall **12*a* of outer jacket 12, to provide the noted dam. Another fiberglass belt 16 may encircle skirt ring 10 below belt 15**, for further insulation.

Present Invention

FIG. 3 illustrates the present invention, and uses like reference numerals from FIGS. 1 and 2 where appropriate to facilitate clarity. Water heater 40 includes a lower skirt ring 42 supporting and spacing inner storage tank 2 above support surface **10*a*. The skirt ring is formed by an annular vertical sidewall 43 having a diameter less than the diameter of tank 2 and engaging the convex bottom wall 9*a* of the tank at point 45 and welded thereto. The bottom wall of the tank may be convex and bow toward support surface 10*a*, FIGS. 3, 4, 8 and 9, or may be concave and bow away from support surface 10*a*, FIGS. 5–7 and 10. Outer jacket 44, FIGS. 3 and 4, around inner storage tank 2 has a main body portion 46 spaced outwardly from tank 2 to define annular cavity space 22 therebetween. Outer jacket 44 has a lower end 48 extending radially inwardly to mate with inner storage tank 2 at point 50 of bottom wall 9*a* radially inwardly of main body portion 46 of outer jacket 44 and forming a dam sealing the lower end of annular space 22. Point 45 is spaced radially inwardly of point 50**.

Outer jacket 44 is slid upwardly around tank 2 until stopped by engagement of lower end 48 with the inner tank at point 50 of bottom wall 9*a*. Foamed insulation introduced as a liquid into annular space 22 hardens to form an annular insulation layer 13 around inner storage tank 2. The dam at point 50 prevents leakage of liquid therepast. The direct engagement of lower jacket end 48 with tank bottom wall 9*a* at point 50 forms a sufficient seal in most foaming applications with the usual ranges of liquid viscosities. For higher viscosity fluids, or where otherwise desirable, a further seal 52 may be provided by caulk, putty, tape, fiberglass batt, or any other suitable material for sealing the interface at point 50.

Inner tank 2 includes annular vertical sidewall 2*a* extending upwardly from bottom 9*a*. In the embodiment shown in FIGS. 3 and 4, lower end 48 of outer jacket 44 extends radially inwardly beyond tank sidewall 2*a*. Alternatively, lower jacket end 48 may extend inwardly about as far as tank wall 2*a* and engage the bottom of the tank at the lower end 2*b* of the tank sidewall 2*a*. It is preferred that outer jacket 44 extend downwardly below annular vertical sidewall 2*a* of the tank.

In FIG. 5, inner storage tank 2 has a concave bottom 9 bowed away from the support surface therebelow. Outer jacket 56 has a main body portion 58 and a lower end 60 extending radially inwardly to mate with tank 2 and form the noted dam. Radially inwardly extending lower end 60 of the outer jacket extends below annular vertical sidewall 2*a* of the inner storage tank and radially inwardly thereof to engage concave bottom 9 of the tank. Lower end 60 of the outer jacket has an upper surface 62 mating with the lower surface 64 of the concave bottom 9 of the tank. Annular sidewall 43 of skirt ring 42 engages concave bottom 9 of the tank and is welded thereto at point 66 spaced radially inwardly of the outer jacket and radially inwardly of the dam formed at interface 62, 64. If desired, lower end of annular cavity space 22 may be further sealed by sealing the interface 62, 64, for example by sealing material at the edge of the interface, such as caulk, putty, tape, fiberglass, or any other suitable material, such as shown at 52 in FIG. 4, or by a gasket 68, FIG. 6, between the top surface 62 of lower jacket end 60 and the bottom surface 64 of concave tank bottom 9.

In FIG. 7, outer jacket 70 has a main body portion 72 and a lower end 74 extending radially inwardly. The outer jacket is inserted upwardly along inner storage tank 2 until lower end 74 mates with the skirt ring to form the noted dam. Skirt ring 42 has an annular flange 76 formed integrally therewith or welded thereto and extending radially outwardly from annular vertical sidewall 43. Alternatively, flange 76 may be formed on or extend from tank 2. Lower end 74 of the outer jacket has an upper surface 78 mating with the undersurface 80 of flange 76 as jacket 70 is inserted upwardly along tank 2.

FIG. 8 shows an embodiment similar to FIG. 7, but with a convex tank bottom 9*a*. Annular vertical sidewall 43 engages tank bottom 9*a* at point 45 and is welded thereto, and has flange 76 extending radially outwardly therefrom. Outer jacket 82 has main body portion 84 and lower end 86 extending radially inwardly and having an upper surface 88 engaging the undersurface 80 of flange 76 to form the noted dam.

In FIG. 9, skirt ring 90 has an annular vertical sidewall 92 engaging and being welded to the tank bottom 9*a* at point 94 generally vertically aligned with tank sidewall 2*a*. Skirt ring 90 has an integral flange 96 extending radially outwardly from sidewall 92 and engaged by lower radially inwardly extending end 98 of outer jacket 100.

FIG. 10 shows an embodiment like FIG. 9, but with a concave tank bottom 9. In FIGS. 7–10, sealing material may be provided at the edges of the noted interfaces, as above, and/or a gasket may be provided between the mating parts, as above.

It is recognized that various equivalents, alternatives and modifications are possible within the scope of the appended claims.

I claim:

1. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly to mate with said inner storage tank at a point radially inwardly of said main body portion of said outer jacket and forming a dam sealing said annular space;

foamed insulation introduced as a liquid into said annular space and hardening to form an annular insulation layer around said inner storage tank, said dam preventing leakage of said liquid therepast, wherein said outer jacket is inserted upwardly along said inner storage tank until said lower radially inwardly extending end mates with said inner storage tank, and comprising sealing means sealing the interface between said inner storage tank and said lower radially inwardly extending end of said outer jacket, wherein said sealing means comprises a gasket between said inner storage tank and said lower radially inwardly extending end of said outer jacket.

2. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly to mate with said inner storage tank at a point radially inwardly of said main body portion of said outer jacket and forming a dam sealing said annular space;

foamed insulation introduced as a liquid into said annular space and hardening to form an annular insulation layer around said inner storage tank, said dam preventing leakage of said liquid therepast, wherein said outer jacket is inserted upwardly along said inner storage tank until said lower radially inwardly extending end mates with said inner storage tank, wherein said inner storage tank has a convex bottom bowed toward said support surface and an annular vertical sidewall extending upwardly from said convex bottom, and wherein said lower end of said outer jacket extends radially inwardly at least to said annular vertical sidewall, wherein said skirt ring comprises a sidewall extending upwardly from said support surface and engaging said convex bottom of said inner storage tank at a point space radially inwardly of the point of engagement of said lower radially inwardly extending end of said outer jacket with said convex bottom of said inner storage tank.

3. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly to mate with said inner storage tank at a point radially inwardly of said main body portion of said outer jacket and forming a dam sealing said annular space;

foamed insulation introduced as a liquid into said annular space and hardening to form an annular insulation layer around said inner storage tank, said dam preventing leakage of said liquid therepast;

wherein said outer jacket is inserted upwardly along said inner storage tank until said lower radially inwardly extending end mates with said storage tank, wherein said inner storage tank has a concave bottom bowed away from said support surface and an annular vertical sidewall extending upwardly from said concave bottom, and wherein said lower end of said outer jacket extends radially inwardly at least to said annular vertical sidewall of said inner storage tank.

4. The invention according to claim 3 wherein said radially inwardly extending lower end of said outer jacket extends below said annular vertical sidewall of said inner storage tank and radially inwardly thereof to engage said concave bottom of said inner storage tank.

5. The invention according to claim 4 wherein said radially inwardly extending lower end of said outer jacket has an upper surface mating with a lower surface of said concave bottom of said inner storage tank.

6. The invention according to claim 3 wherein said lower skirt ring comprises a sidewall extending upwardly from said support surface and engaging said concave bottom of said inner storage tank at a point spaced radially inwardly of said lower radially inwardly extending end of said outer jacket.

7. The invention according to claim 6 wherein the point of engagement of said sidewall of said lower skirt ring with said concave bottom of said inner storage tank is radially inward of said dam.

8. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly, said outer jacket being inserted upwardly along said inner storage tank until said lower end mates with one of said inner storage tank and said skirt ring to form a dam sealing said annular space;

foamed insulation introduced as a liquid into said annular space and hardening to form an annular insulation layer around said inner storage tank, said dam preventing leakage of said liquid therepast, wherein said inner storage tank has a bottom and an annular vertical sidewall extending upwardly therefrom, and wherein said lower radially inwardly extending end of said outer jacket mates with said inner storage tank at a point spaced radially inwardly of said annular vertical sidewall of said inner storage tank.

9. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly, said outer jacket being inserted upwardly along said inner storage tank until said lower end mates with one of said inner storage tank and said skirt ring to form a dam sealing said annular space;

foamed insulation introduced as a liquid into said annular space and hardening to form an annular insulation layer around said inner storage tank, said dam preventing leakage of said liquid therepast, wherein said inner storage tank has a bottom and an annular vertical sidewall extending upwardly therefrom, and wherein said lower radially inwardly extending end of said outer jacket mates with said inner storage tank at a point generally aligned with said annular vertical sidewall of said inner storage tank.

10. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly, said outer jacket being inserted upwardly along said inner storage tank until said lower end mates with one of said inner storage tank and said skirt ring to form a dam sealing said annular space;

foamed insulation introduced as a liquid into said annular space and hardening to form an annular insulation layer around said inner storage tank, said dam preventing leakage of said liquid therepast, wherein said lower radially inwardly extending end of said outer jacket mates with said inner storage tank at a point spaced radially outwardly of said annular vertical sidewall of said inner storage tank.

11. An insulated fluid storage unit comprising:

an inner storage tank;

a lower skirt ring supporting and spacing said inner storage tank above a support surface;

an outer jacket around said inner storage tank and having a main body portion spaced outwardly from said inner storage tank to define an annular space therebetween, said outer jacket having a lower end extending radially inwardly, said outer jacket being inserted upwardly along said inner storage tank until said lower end mates with one of said inner storage tank and said skirt ring to form a dam sealing said annular space;

foamed insulation introduced as a liquid into said annular space and hardening to form an annular insulation layer around said inner storage tank, said dam preventing leakage of said liquid therepast, wherein one of said lower skirt ring and said inner storage tank has an annular flange extending radially outwardly therefrom, and wherein said lower radially inwardly extending end of said outer jacket has an upper surface mating with the undersurface of said last mentioned flange as said outer jacket is inserted upwardly along said inner storage tank.

12. The invention according to claim 11 wherein said last mentioned flange extends radially outwardly from said lower skirt ring.

13. The invention according to claim 12 wherein said inner storage tank has a concave bottom bowed away from said support surface, and wherein said flange of said skirt ring extends radially outwardly to engage said inner storage tank.

14. The invention according to claim 12 wherein said inner storage tank has a convex bottom bowed toward said support surface, and wherein said flange extends radially outwardly from the point of engagement of said skirt ring with said inner storage tank.

* * * * *